US010440488B2

(12) United States Patent
Lection et al.

(10) Patent No.: US 10,440,488 B2
(45) Date of Patent: Oct. 8, 2019

(54) INTELLIGENT AUDIO CONTROL

(71) Applicant: INTERNATIONAL BUSINESS MACHINES CORPORATION, Armonk, NY (US)

(72) Inventors: David B. Lection, Raleigh, NC (US); Sarbajit K. Rakshit, Kolkata (IN); Mark B. Stevens, Austin, TX (US); John D. Wilson, League City, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/193,201

(22) Filed: Jun. 27, 2016

(65) Prior Publication Data

US 2017/0374481 A1 Dec. 28, 2017

(51) Int. Cl.

| | |
|---|---|
| ***H04R 29/00*** | (2006.01) |
| ***H04R 3/00*** | (2006.01) |
| ***H04R 1/32*** | (2006.01) |

(52) U.S. Cl.

CPC ..... *H04R 29/001* (2013.01); *H04R 1/323* (2013.01); *H04R 3/00* (2013.01); *H04R 2201/025* (2013.01); *H04R 2430/01* (2013.01)

(58) Field of Classification Search

None

See application file for complete search history.

(56) References Cited

U.S. PATENT DOCUMENTS

| | | | | |
|---|---|---|---|---|
| 2005/0105744 | A1* | 5/2005 | Lee | H04S 7/302 381/86 |
| 2007/0140532 | A1* | 6/2007 | Goffin | G06K 9/00288 382/118 |
| 2008/0044037 | A1* | 2/2008 | Mainz | H04R 3/007 381/96 |
| 2008/0116764 | A1* | 5/2008 | Heim | F04B 43/0054 310/329 |
| 2008/0130923 | A1* | 6/2008 | Freeman | G06F 3/167 381/303 |
| 2008/0159566 | A1* | 7/2008 | Konagai | H04R 1/403 381/111 |
| 2012/0063607 | A1 | 3/2012 | Tong et al. | |
| 2015/0189438 | A1* | 7/2015 | Hampiholi | G06F 3/165 381/80 |
| 2016/0103488 | A1* | 4/2016 | Levesque | G06F 3/016 345/156 |

(Continued)

FOREIGN PATENT DOCUMENTS

| | | | |
|---|---|---|---|
| JP | 2011004957 | A | 1/2011 |
| WO | 2013042326 | A1 | 3/2013 |

OTHER PUBLICATIONS

Weber, Ralph. "Piezo Motor Based Medical Devices." pp. 1-7. Apr. 2, 2009. https://www.mdtmag.com/article/2009/04/piezo-motor-based-medical-devices.*

*Primary Examiner* — Qin Zhu

(74) *Attorney, Agent, or Firm* — Griffiths & Seaton PLLC

(57) ABSTRACT

Embodiments for manipulating an audio environment by a processor. A noncalibrative stimulus is detected in the audio environment. In response to the detected noncalibrative stimulus, a component in the audio environment is caused to modify an audio characteristic in order to change a physical property of sound generated in the audio environment.

15 Claims, 7 Drawing Sheets

(56) References Cited

U.S. PATENT DOCUMENTS

| | | | | |
|---|---|---|---|---|
| 2016/0154437 | A1* | 6/2016 | Kim | H04R 1/02 345/173 |
| 2016/0174011 | A1* | 6/2016 | Rider | H04S 7/303 381/303 |
| 2016/0286316 | A1* | 9/2016 | Bleacher | H04R 5/023 |
| 2017/0012591 | A1* | 1/2017 | Rider | H03G 3/3005 |
| 2017/0052594 | A1* | 2/2017 | Birnbaum | G06F 3/016 |

* cited by examiner

INTELLIGENT AUDIO CONTROL

BACKGROUND OF THE INVENTION

Field of the Invention

The present invention relates in general to computing systems, and more particularly to, various embodiments for manipulating sound in an audio environment using a computing processor.

Description of the Related Art

In today's society, consumers, users, and other individuals find themselves in audio environments (environments using speakers and other sound generating devices). Audio installations are increasingly found in places throughout homes, businesses, churches, and other places. For example, a consumer may install a whole-home audio system in their home, to be used to play music in various forms in each room in the home that the system is installed. Increasingly, these sound environments are controlled by microprocessors, to distribute the sound and otherwise control other features, such as volume and source of the audio.

SUMMARY OF THE INVENTION

Various embodiments for manipulating an audio environment by a processor are provided. In one embodiment, by way of example only, a method for manipulating an audio environment is provided. A noncalibrative stimulus is detected in the audio environment. In response to the detected noncalibrative stimulus, a component in the audio environment is caused to modify an audio characteristic in order to change a physical property of sound generated in the audio environment.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
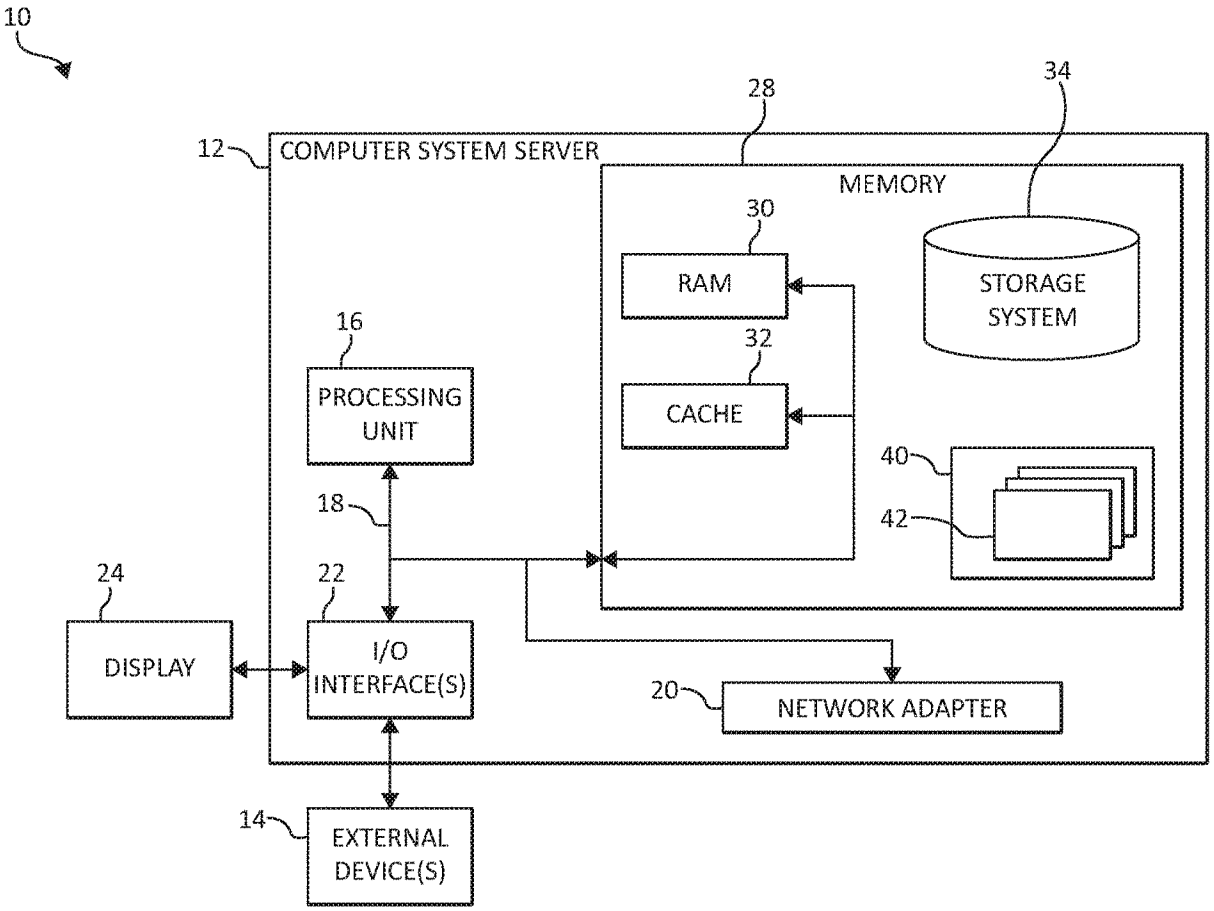
FIG. 1 is a block diagram depicting an exemplary cloud computing node according to an embodiment of the present invention.

As previously indicated, the installation of audio equipment in various locations has proliferated in recent years. Loudspeakers (transducers) and similar electroacoustic components are now installed and sound environments are found in a wide variety of places and situations to create various kinds of ambiance. In some cases, however, persons, pets, and inanimate objects may come in proximity to loudspeakers that may not be best suited for a particular audio environment's configuration at a particular time. For example, children or elderly persons may find themselves in audio environments that have default settings that are unpalatable, or potentially hazardous to their hearing.

In another example, an object, such as an emptied wine glass left in a particular setting, may become susceptible to breakage if the volume or frequency of the sound setting in the environment is set too high. Finally, different users may have differing preferences as to the particular quality, or other characteristics, of the sound emanating from loudspeakers in a particular situation, for example.

In view of the foregoing, a need exists for mechanisms whereby, if physical circumstances of a particular audio environment are determined to have changed, accordingly various acoustical qualities of a particular audio environment may be correspondingly changed. For example, taking the aforementioned situation where a child finds themselves in a home theater environment getting ready to watch a movie, the default settings of the home theater are sensed upon recognition that the physical surroundings in the sound environment have changed (i.e., the presence of the child in the environment in close proximity to the loudspeakers).

The mechanisms of the illustrated embodiments, among other aspects, can recognize the presence of objects, people, pets, and other physical properties in a particular sound environment, and take immediate action to change the sound qualities, and direction of sound in the environment in response. The changing of settings may be in response to the detection of a particular scenario to enhance safety (such as detection of the child, to reduce volume, sound quality and/or direction of the sound), or the changing of settings may be in response to user preferences. For example, the mechanisms may detect the entrance of a particular individual into the sound environment, where that individual has stored predetermined sound settings corresponding to individual preferences. Further, the mechanisms may implement a particular sound setting to cause various sound effects in accordance with the individual's preferences.

With the entrance and detection of that person in the sound environment, the mechanisms of the illustrated embodiments may make immediate changes as a background process, or even notify the user that one or more settings are set to a different setting than she prefers, and ask if the user would prefer that the settings be reset to her preference. In each of these scenarios, the mechanisms of the illustrated embodiments may tailor the sound embodiment according to the physical characteristics that are found in the sound environment at any given time.

The mechanisms of the illustrated embodiments, as will be further described and again among other aspects, may use material disposed on, or otherwise integrated into, various surfaces of the electroacoustic component, in order to change the characteristics of the sound emanating from the component, such as volume, direction of the sound, and other acoustical qualities of the sound. In one embodiment, the mechanisms use an electroactive polymer (EAP) material, as will be further described, in conjunction with the surfaces of a loudspeaker. In a particular scenario, for example, when a change in acoustical properties is desired, the mechanisms of the illustrated embodiments may implement the use of electromagnetic signals, which are received by the EAP associated with the particular loudspeaker. When the electromagnetic signals pass through the EAP material, the EAP material then responds in a predetermined way to deform the surface(s) of the speaker, and thereby change the sound characteristics.

As will be further described, the mechanisms of the illustrated embodiments may make use of a wide variety of input devices, such as microphones and camera devices, to make determinations of various physical characteristics in the audio environment at a given time. For example, a camera or sonar-based device may indicate the entrance of a particular individual, who may be recognized using facial recognition technology or by the individual's acoustical signature, as one of ordinary skill in the art will appreciate. Once the determination of the particular individual is made, the mechanisms may then implement the corresponding setting changes in the audio environment.

In an additional exemplary embodiment, the mechanisms may detect the entrance of a child into the audio environment, and based on the stored parental control settings entered by an administrator of the system at an earlier time, may make default setting adjustments of the audio environment, such as limiting the maximum volume of the loudspeakers, or changing the direction of the sound in the environment in accordance with one or more predetermined settings set under the parental control framework. These settings may then be locked, so that the child is unable to change the particular settings. As will be seen, a wide variety of controllable scenarios may be predetermined such that upon recognition of a particular physical phenomenon in the sound environment, the predetermined scenario is triggered without delay. The foregoing aspects and other related aspects of the illustrated embodiments will be further detailed, following.

As a preliminary matter, it is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, system memory 28 may include at least one program product having a set (e.g., at least one) of program modules that are configured to carry out the functions of embodiments of the invention.

Program/utility 40, having a set (at least one) of program modules 42, may be stored in system memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
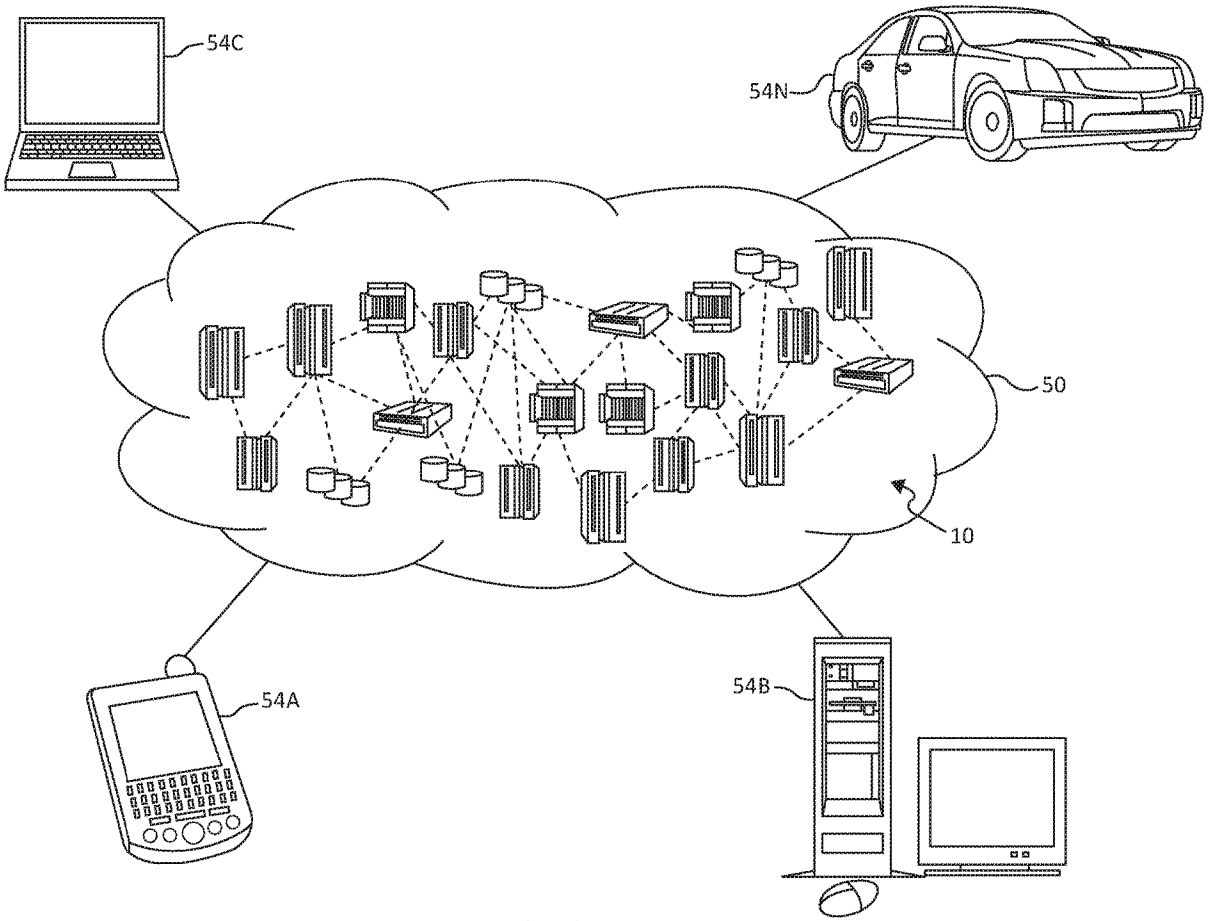
FIG. 2 is an additional block diagram depicting an exemplary cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, smartphone or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 2 are intended to be illustrative only and that computing nodes 10 and cloud computing environment 50 can communicate with any type of computerized device over any type of network and/or network addressable connection (e.g., using a web browser).

Figure 3:
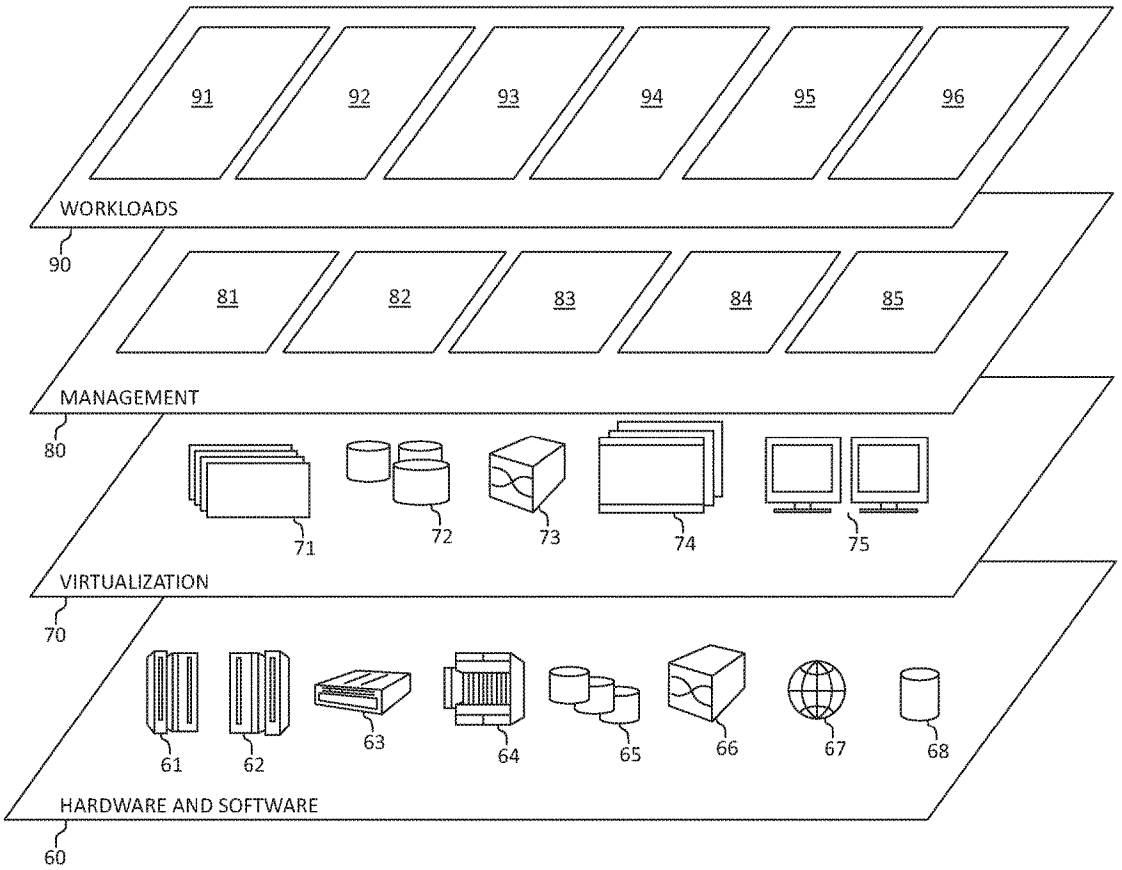
FIG. 3 is an additional block diagram depicting abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provides pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and, in the context of the illustrated embodiments of the present invention, various acoustical workloads and functions 96. In addition, acoustical workloads and functions 96 may include such operations as acoustical analytics, visual, acoustical, and environmental analysis, acoustical modeling, and as will be further described, acoustical control functions. One of ordinary skill in the art will appreciate that the acoustical workloads and functions 96 may also work in conjunction with other portions of the various abstraction layers, such as those in hardware and software 60, virtualization 70, management 80, and other workloads 90 (such as data analytics processing 94, for example) to accomplish the various purposes of the illustrated embodiments of the present invention.

Figure 4:
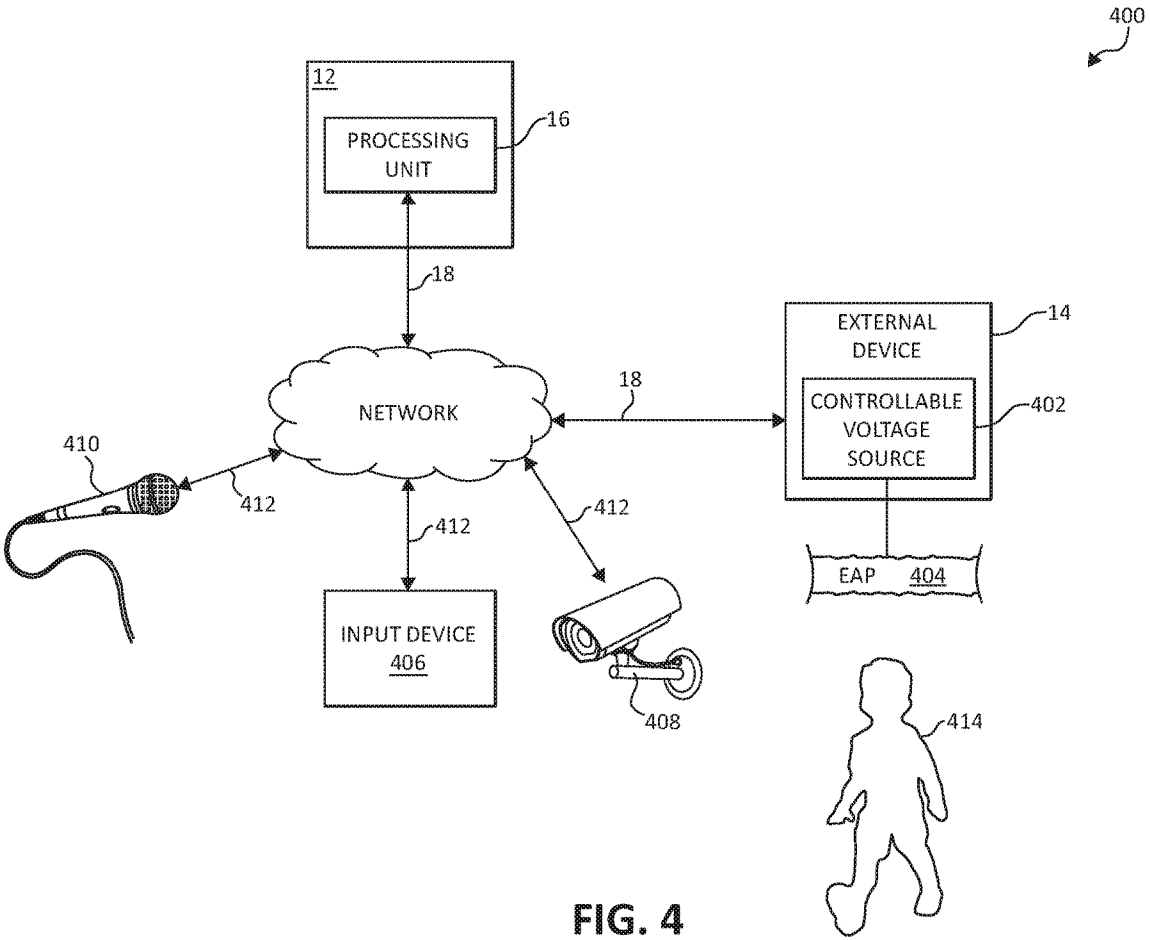
FIG. 4 is an additional block diagram depicting various interconnected computing components, input devices, and control devices functioning in accordance with aspects of the present invention.

Turning now to FIG. 4, a block diagram depicting exemplary functional components 400 according to various mechanisms of the illustrated embodiments, is shown. Computer system/server 12 (FIG. 1) is again shown incorporating processing unit 16 for purposes of illustration to demonstrate that one or more distributed computing components (in a cloud-based system, or otherwise) may be configured so as to accomplish various aspects of the illustrated embodiments. In addition, bus/communication path 18 is shown connecting the computer system/server 12 through an exemplary network to a particular sound environment to be controlled. Here, as one of ordinary skill will appreciate, the network and associated communications path 18 may include wide and local area networks, home networks, wireless networks, and the like.

In closer proximity to, or within the audio environment may lie an external device 14 as shown, incorporating a controllable voltage source 402, or as one of ordinary skill in the art will appreciate, any number of controllable electronic components such as electromagnetic components, amplifiers, signal generators, other processing devices, sensors, and the like. In the instant figure, the external device 14 is coupled to the EAP material 404 as shown to provide, for example, a voltage differential across two nodes of at least a portion of the EAP material. As one of ordinary skill in the art will appreciate, the portion of the EAP material 404 shown is only representative of what may be a vast network of EAP material and electrical lines coupled, for example, in circuit form, with the controllable voltage source 402 (and further, coupled in such a manner such that portions of the EAP may be actuated, while other portions are not actuated at a particular time).

As previously mentioned, the EAP material 404 may be associated with the surface(s) of a particular electroacoustic component, such as a loudspeaker in a variety of ways. The EAP material 404 may be adhered to a surface of the loudspeaker housing that is made to flex, for example. A variety of loudspeaker housings may be selected for particular acoustical properties for a particular installation. Additionally, the EAP material 404 may be adhered to a surface of the loudspeaker itself, such as to the paper cone of a woofer. Finally, the EAP material 404 may itself be integrated into the loudspeaker, such that, for example, the woofer structure is designed to respond to electromagnetic stimulus from the controllable voltage source 402 in differing ways. In addition, and as previously mentioned, the EAP material 404 may be mechanically coupled to the electroacoustic component such that the EAP material 404 causes the electroacoustic component to change position, such as rotate, swivel, or other motion (i.e., the positioning of the surfaces of the loudspeaker itself may change orientation, for example) so that the emanated sound propagates from a different direction.

In addition to the foregoing, the EAP material may be coupled to a frame containing an existing electroacoustic component, such as a loudspeaker. In this way, the EAP may be used to tune an existing loudspeaker design so that the sound could be aimed or focused in a variety of ways to suit a particular application.

In addition to the controllable loudspeaker components which are shown using an embodiment using the EAP material 404, the sound environment may also incorporate a number of input devices 406, such as the aforementioned sonar device 406 that sends acoustical information into a particular room and measures a response, or by a microphone 410 or visual and/or infrared camera 408, or any other input device known to one of ordinary skill in the art that may be made to supply acoustical, visual, and other information pertaining to the sound environment at a given time. Finally, an exemplary stimulus, the entrance of a child 414 into the audio environment, is depicted.

In one embodiment of the present invention, the various components 400 work together to change the acoustical aspects of the sound environment in response to what will be termed herein as a "noncalibrative stimulus" (to differentiate the stimulus from a stimulus generated to calibrate and test the audio environment, for example). The stimulus may be, as previously mentioned, the presence of an inanimate object that may be damaged by high sound pressure levels, the detected presence of a family pet, for example, or in the depicted embodiment, the detected presence of the child 414 in close enough proximity to the loudspeakers that the child's hearing may be damaged were a particular setting in the audio environment left in place. In the depicted embodiment, the camera 408 may be the input device responsible for detecting the physical presence of the child 414 in the audio environment. For example, and as will be further described, the mechanisms of the illustrated embodiments may, upon detecting the child 414, take steps to either (1) reduce the volume/sound pressure level of the current setting (s) in the audio environment or/and (2) change the orientation/position of the loudspeakers through the action of sending electromagnetic information through the EAP material, causing the loudspeakers to change shape, orientation, and/or position to aim the generated sound in a direction away from the child 414.

Figure 5B:
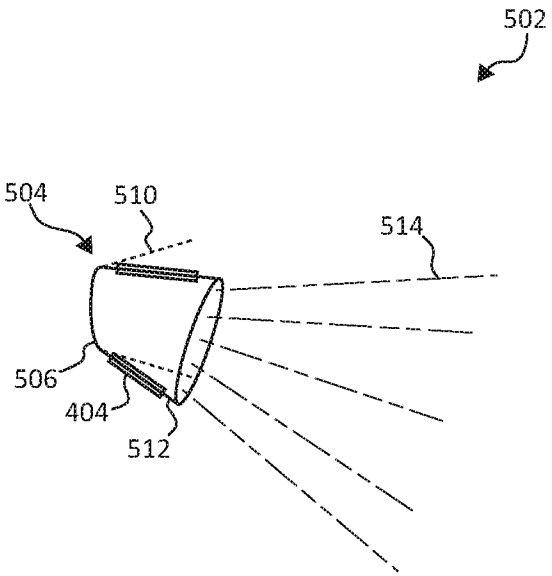
FIG. 5B is an additional block diagram depicting the exemplary portion of the loudspeaker previously depicted in FIG. 5A, here showing a portion of a surface of the loudspeaker being deformed, changing a direction of the sound emanating from the loudspeaker, in accordance with various aspects of the present invention.
Figure 5A:
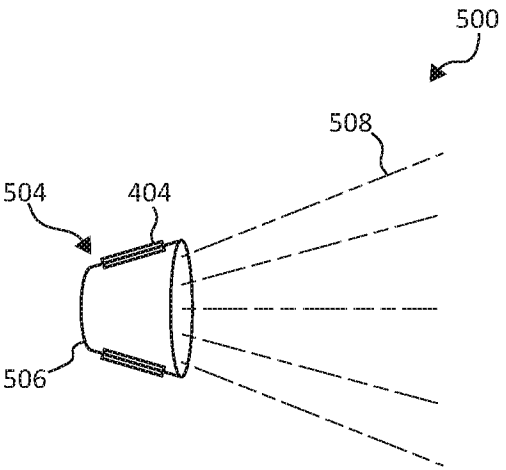
FIG. 5A is an additional block diagram depicting an exemplary portion of a loudspeaker incorporating controllable surfaces.

Turning now to FIG. 5A, a block diagram of an existing audio environment 500 where (among other acoustical components not shown for purposes of illustration) electroacoustic component 504, in this case loudspeaker 504, in a particular audio environment is depicted, in which various aspects of the illustrated embodiments may be implemented in accordance with the present invention. The loudspeaker 504 may have an accompanying housing 506 or frame 506, or in another embodiment, the loudspeaker surface itself (e.g., cone) is represented by 506. The EAP material 404 is, in the instant embodiment, disposed on the loudspeaker housing/loudspeaker surface 506 as shown. As one of ordinary skill in the art will appreciate, when the loudspeaker 506 is in operation, sound waves 508 are generated therefrom as shown.

FIG. 5B, following, shows the same loudspeaker 504 in a scenario 502 where the loudspeaker is being controlled in accordance with various aspects of the illustrated embodiments. Here again, the loudspeaker 504 is accompanied by various EAP material 404 that is disposed on the loudspeaker housing/loudspeaker surface 506. The loudspeaker 504 has received, through the EAP material 404, various electromagnetic signals, that have caused the loudspeaker housing/surface 506 to deform, here represented by reference to the original form of the loudspeaker in portion 510 and by the deformed shape of the loudspeaker housing/surface 506 represented by portion 512 in comparison.

As shown, once the loudspeaker housing/surface 506 has been deformed as indicated, the acoustical properties of the sound have changed. In the depicted embodiment, the sound waves 514 are deflected downwards (e.g., in a different direction). Accordingly, the overall direction in which the sound information emanates from the loudspeaker 504 is changed in relation to the way that the shape of the loudspeaker surface 506 is deformed (original shape 510, deformed shape 512).

FIGS. 5A and 5B are only one possible embodiment depicting a particular mechanism for changing acoustical properties of the electroacoustic component 504/loudspeaker 504. In alternative embodiments, and as one of ordinary skill in the art will appreciate, the loudspeaker 504 may be rotated around a particular axis to change the emanated sound, or the volume (i.e., voltage) going to the loudspeaker 504 itself may be adjusted. In additional embodiments, other material (perhaps making use of EAP material 404, or use of other materials) may be used to partially shield the loudspeaker 504 or another acoustical component from the external portion of the sound environment. Any number of mechanical and/or electromagnetic mechanisms may be employed in conjunction with the loudspeaker 504 and other components of a particular sound environment such that the acoustical properties of the environment are changed.

Figure 6:
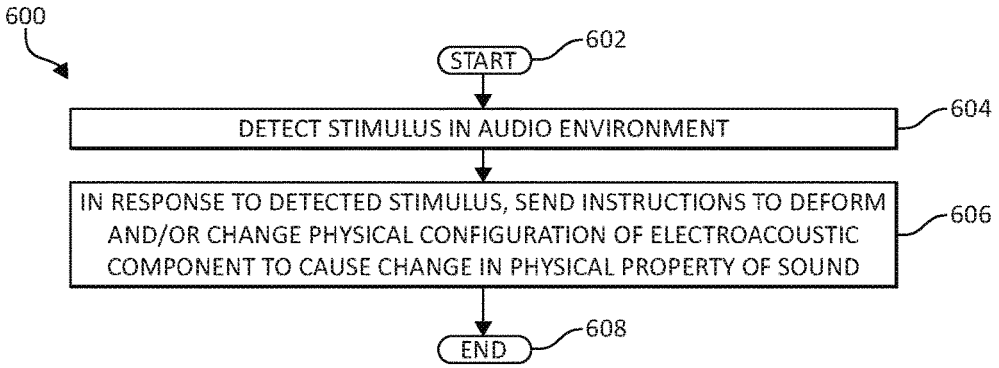
FIG. 6 is a flow chart diagram of an exemplary method for manipulating an audio environment by a processor, in which various aspects of the present invention may be implemented.

With the foregoing in view, consider now FIG. 6, which is a flow chart of an exemplary method 600 for manipulating an audio environment by a processor, in which various aspects of the illustrated embodiments may be implemented according to the present invention. In the depicted embodiment, the applicable electroacoustic component being controlled is a loudspeaker, as will be shown. Method 600 begins with the detection of the aforementioned stimulus in the audio environment (step 602). In response to the detected stimulus, the processor causes the loudspeaker surface and/or housing and/or other supporting structures to be deformed, to cause a change in the physical property of sound generated by the loudspeaker (step 606). The method 600 then ends (step 608).

In other embodiments, the mechanisms of the present invention may control various settings and configurations of the audio equipment itself in response to the stimulus, such as the audio amplifier, to change audio characteristics such as amplitude, direction, and phase, to cause changes in the physical properties of sound. In this way, the mechanisms of the illustrated embodiments may physically change sound generating electroacoustic components in the audio environment, physically change supporting structures tied to the sound generating components (also referred to herein generically as "components"), or electronically change the emanated sound in response to a particular stimulus in real time.

Figure 7:
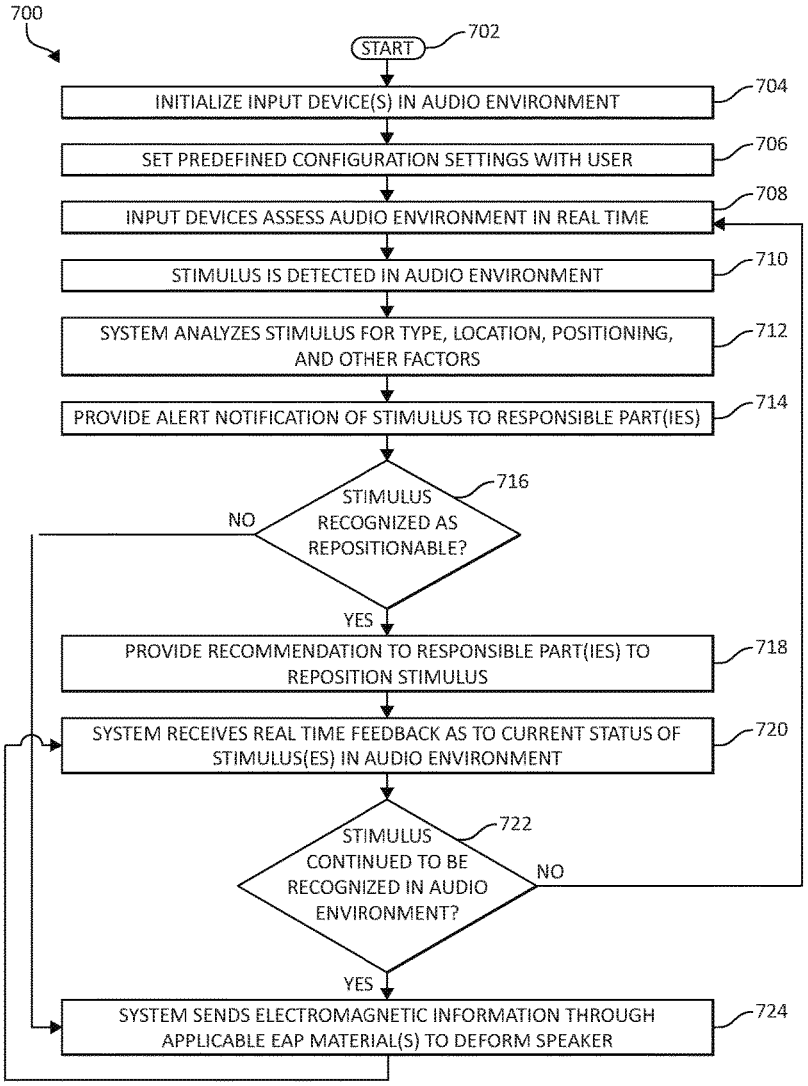
FIG. 7 is an additional flow chart diagram of an additional exemplary method for manipulating an audio environment by a processor, here again in which various aspects of the present invention may be implemented.

Turning now to FIG. 7, following, an additional flow chart of an exemplary method 700 for manipulating an audio environment by a processor is depicted, here again in which various aspects of the illustrated embodiments may be implemented. The method 700 begins (step 702) with the initialization of various input devices, such as the microphones, cameras, sonar-based, and other input devices in the audio environment (step 704).

In a following step 706, a variety of predetermined configuration settings may be defined, and set in the system by a user. For example, the user may wish to set parental control settings, which cause the electroacoustic component to lower the volume of emitted sound, and/or change the direction of the sound upon the detection of a child in the particular audio environment.

Once the various configuration settings are stored, the various input devices begin to assess the audio environment in real time for any stimulus, be it acoustic, physical, or otherwise (step 708). Once a stimulus is detected in the audio environment (step 710), the system analyzes the stimulus for type, location, positioning, and other factors associated with the stimulus (step 712). For example, based on the system analysis, a child may be detected in proximity to the electroacoustic component that is potentially hazardous in a given audio setting. The system then provides an alert notification of the stimulus with related factors (type, position, etc.) to the individual responsible (step 714).

The method 700 then moves to decision step 714, which queries if the stimulus is recognized as repositionable. If so, the recommendation for the responsible person to remove the stimulus is made to the responsible part(ies) to reposition the object (step 718), and the system receives real time feedback as to the current status of stimulus(es) in the audio environment (step 720). If the stimulus is continued to be recognized in the audio environment (decision step 722), or returning to decision step 716, if the stimulus is recognized as non-repositionable, the method 700 then moves to step 724, where the system causes electromagnetic information to be sent through the applicable EAP material(s) associated with the electroacoustic component to change the physical quality of the generated sound in accordance with the predetermined configuration settings, or by a default configuration setting according to the detected stimulus and corresponding acoustical analysis.

The method then returns to step 720, where the system again receives real time feedback through the various input devices as to the current status of the stimulus, and current acoustical properties of the audio environment. Once the stimulus is determined to no longer be present (again, decision step 722), the method 700 returns to step 708, where the system again begins assessing the audio environment in real time and checks for new stimulus.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowcharts and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts or carry out combinations of special purpose hardware and computer instructions.

The invention claimed is:

1. A method for manipulating an audio environment by a processor, comprising:

detecting a noncalibrative stimulus in the audio environment using a camera or sonar-based device to determine the noncalibrative stimulus is within a predetermined proximity to a component in the audio environment, the predetermined proximity being set and adjusted by the processor; wherein determining the noncalibrative stimulus is within a predetermined proximity to the component in the audio environment comprises detecting that a particular individual has entered the audio environment, the particular individual having previously stored predetermined sound settings associated with individual preferences of the particular individual; and wherein the particular individual is identified using facial recognition technology or an acoustic signature of the particular individual; and in response to the detected noncalibrative stimulus, causing the component in the audio environment to modify an audio characteristic corresponding to the predetermined sound settings in order to change a physical property of sound generated in the audio environment; wherein causing the component in the audio environment to modify the audio characteristic further includes causing a surface cone of the component comprising a loudspeaker to deform in the audio environment without physical manipulation of the surface cone by a user such as to deflect the sound generated by the surface of the component in a predetermined direction according to the deformation.

2. The method of claim 1, wherein causing the component in the audio environment to modify the audio characteristic further includes causing a modification in an amplitude, a direction, or a phase to change the physical property of sound generated in the audio environment.

3. The method of claim 1, wherein causing the component in the audio environment to modify the audio characteristic further includes:

causing a change in a position of the component to cause the sound to emanate in a differing direction, or causing the component to produce a higher or lower sound pressure level.

4. The method of claim 1, further including instructing an electromagnetic signal to be sent through an electroactive polymer (EAP) in mechanical communication with the component in the audio environment to cause the component to deform.

5. The method of claim 1, wherein detecting the noncalibrative stimulus in the audio environment further includes:

detecting a noncalibrative acoustical stimulus from a source external to the component, detecting a noncalibrative physical stimulus within the predetermined proximity to the component, receiving acoustical feedback input from the audio environment subsequent to causing the component in the audio environment to modify the audio characteristic, to determine if the modification to the audio characteristic meets a predetermined criteria, or upon detecting the noncalibrative stimulus, providing an alert notification to a user of the detected noncalibrative stimulus within the audio environment.

6. A system for manipulating an audio environment, comprising:

a processor, operable to receive input from the audio environment, that:

detects a noncalibrative stimulus in the audio environment using a camera or sonar-based device to determine the noncalibrative stimulus is within a predetermined proximity to a component in the audio environment, the predetermined proximity being set and adjusted by the processor; wherein determining the noncalibrative stimulus is within a predetermined proximity to the component in the audio environment comprises detecting that a particular individual has entered the audio environment, the particular individual having previously stored predetermined sound settings associated with individual preferences of the particular individual; and wherein the particular individual is identified using facial recognition technology or an acoustic signature of the particular individual, and in response to the detected noncalibrative stimulus, causes the component in the audio environment to modify an audio characteristic corresponding to the predetermined sound settings in order to change a physical property of sound generated in the audio environment; wherein causing the component in the audio environment to modify the audio characteristic further includes causing a surface cone of the component comprising a loudspeaker to deform in the audio environment without physical manipulation of the surface cone by a user such as to deflect the sound generated by the surface of the component in a predetermined direction according to the deformation.

7. The system of claim 6, wherein the processor, pursuant to causing the component in the audio environment to modify the audio characteristic, causes a modification in an amplitude, a direction, or a phase to change the physical property of sound generated in the audio environment.

8. The system of claim 6, wherein the processor, pursuant to causing the component in the audio environment to modify the audio characteristic:

causes a change in a position of the component to cause the sound to emanate in a differing direction, or causes the component to produce a higher or lower sound pressure level.

9. The system of claim 6, wherein the processor instructs an electromagnetic signal to be sent through an electroactive polymer (EAP) in mechanical communication with the component in the audio environment to cause the component to deform.

10. The system of claim 6, wherein the processor:

detects a noncalibrative acoustical stimulus from a source external to the component, detects a noncalibrative physical stimulus within the predetermined proximity to the component, receives acoustical feedback input from the audio environment subsequent to causing the component in the audio environment to modify the audio characteristic, to determine if the modification to the audio characteristic meets a predetermined criteria, or upon detecting the noncalibrative stimulus, provides an alert notification to a user of the detected noncalibrative stimulus within the audio environment.

11. A computer program product for manipulating an audio environment by a processor, the computer program product comprising a non-transitory computer-readable storage medium having computer-readable program code portions stored therein, the computer-readable program code portions comprising:

an executable portion that detects a noncalibrative stimulus in the audio environment using a camera or sonar-based device to determine the noncalibrative stimulus is within a predetermined proximity to a component in the audio environment, the predetermined proximity being set and adjusted by the processor; wherein determining the noncalibrative stimulus is within a predetermined proximity to the component in the audio environment comprises detecting that a particular individual has entered the audio environment, the particular individual having previously stored predetermined sound settings associated with individual preferences of the particular individual; and wherein the particular individual is identified using facial recognition technology or an acoustic signature of the particular individual; and an executable portion that, in response to the detected noncalibrative stimulus, causes the component in the audio environment to modify an audio characteristic corresponding to the predetermined sound settings in order to change a physical property of sound generated in the audio environment; wherein causing the component in the audio environment to modify the audio characteristic further includes causing a surface cone of the component comprising a loudspeaker to deform in the audio environment without physical manipulation of the surface cone by a user such as to deflect the sound generated by the surface of the component in a predetermined direction according to the deformation.

12. The computer program product of claim 11, further including an executable portion that, pursuant to causing the component in the audio environment to modify the audio characteristic, causes a modification in an amplitude, a direction, or a phase to change the physical property of sound generated in the audio environment.

13. The computer program product of claim 11, further including an executable portion that, pursuant to causing the component in the audio environment to modify the audio characteristic:

causes a change in a position of the component to cause the sound to emanate in a differing direction, or causes the component to produce a higher or lower sound pressure level.

14. The computer program product of claim 11, further including an executable portion that instructs an electromagnetic signal to be sent through an electroactive polymer (EAP) in mechanical communication with the component in the audio environment to cause the component to deform.

15. The computer program product of claim 11, further including an executable portion that:

detects a noncalibrative acoustical stimulus from a source external to the component;

detects a noncalibrative physical stimulus within the predetermined proximity to the component;

receives acoustical feedback input from the audio environment subsequent to causing the component in the audio environment to modify the audio characteristic, to determine if the modification to the audio characteristic meets a predetermined criteria; or upon detecting the noncalibrative stimulus, provides an alert notification to a user of the detected noncalibrative stimulus within the audio environment.

* * * * *